US006449143B2

(12) United States Patent
Rooyakkers et al.

(10) Patent No.: US 6,449,143 B2
(45) Date of Patent: Sep. 10, 2002

(54) OPERATOR WORKSTATION

(75) Inventors: Albert Rooyakkers, Norton, MA (US); John Porter, Attleboro, MA (US)

(73) Assignee: The Foxboro Company, Foxboro, MA (US)

( * ) Notice: Subject to any disclaimer, the term of this patent is extended or adjusted under 35 U.S.C. 154(b) by 0 days.

(21) Appl. No.: 09/776,092

(22) Filed: Feb. 2, 2001

Related U.S. Application Data

(60) Continuation of application No. 09/239,688, filed on Jan. 29, 1999, now Pat. No. 6,212,068, which is a division of application No. 29/091,241, filed on Jul. 24, 1998, now Pat. No. Des. 415,124

(60) Provisional application No. 60/102,712, filed on Oct. 1, 1998.

(51) Int. Cl.[7] ..... H05K 5/00

(52) U.S. Cl. ..... 361/681; 361/682; 361/683; 312/208.1

(58) Field of Search ..... 361/680–689; 312/7.2, 208.1; 108/50.01; 248/917–923

(56) References Cited

U.S. PATENT DOCUMENTS

| | | | | | |
|---|---|---|---|---|---|
| D203,121 | S | * | 12/1965 | Barecki et al. | D33/11 |
| D212,756 | S | * | 11/1968 | Davis et al. | D26/5 |
| D213,592 | S | * | 3/1969 | Anders | D56/4 |
| D218,312 | S | | 8/1970 | Kelemen et al. | D26/5 |
| 3,641,266 | A | | 2/1972 | Stults et al. | 178/6.8 |
| D234,371 | S | | 2/1975 | Olson | D61/1 N |
| D235,360 | S | | 6/1975 | Brucker | D34/5 DD |
| D241,035 | S | * | 8/1976 | Karlin | D14/2 |
| D305,686 | S | * | 1/1990 | Fischer | D24/17 |
| 4,920,458 | A | * | 4/1990 | Jones | 362/33 |
| D317,596 | S | | 6/1991 | Takekoshi et al. | D14/103 |
| 5,224,060 | A | | 6/1993 | Ma | 364/708 |
| 5,224,861 | A | * | 7/1993 | Glass et al. | 434/35 |
| D339,571 | S | * | 9/1993 | Drabczyk et al. | D14/103 |
| D340,235 | S | * | 10/1993 | Robak et al. | D14/113 |
| D341,575 | S | * | 11/1993 | Drabczyk et al. | D14/103 |
| 5,268,817 | A | | 12/1993 | Miyagawa et al. | 361/729 |

(List continued on next page.)

FOREIGN PATENT DOCUMENTS

| | | | | |
|---|---|---|---|---|
| JP | 5-257568 A | * | 10/1993 | G06F/1/16 |
| JP | 8-54962 | * | 2/1996 | G06F/1/16 |

OTHER PUBLICATIONS

Brochure: "Evans Consoles: Series 200 Console System".
Brochure: DAMAC, "LANBase Network Furniture" (1996, DAMAC, Products, Inc.)
Brochure: Engineered Data Products, "Changing Perspectives in Workspace Design", (1997, Engineered Data Products, Inc.).
Brochure: Engineered Data Products, NetCom Series (1997, Engineered Data Products, Inc. Part # Next–BROCH).
Brochure: Holmes & Narver McClier, Information Technology Group, Integrated Services, "Integrated Approach".
Brochure: The FoxBoro Company, "Product Specifications", I/A Series Hardware Modular Industrial Console, (1996–97, The Foxboro Company).
Brochure: The Foxboro Company, "Product Specifications: I/A Series Modulare Industrial Workstation".

*Primary Examiner*—Darren Schuberg
*Assistant Examiner*—Anatoly Vortman
(74) *Attorney, Agent, or Firm*—Foley, Hoag & Eliot LLP

(57) ABSTRACT

An operator workstation has a worksurface and left and right upper support members extending upward from the worksurface. Multiple flat-panel display units are mounted between the support members above the level of the worksurface. The displays are mounted above one another, between the support members. Lower support members support the workstation in connection with a base mounted between the lower support members. The base has a substantially triangular cross-section, while the lower support members have a substantially triangular shape.

67 Claims, 13 Drawing Sheets

U.S. PATENT DOCUMENTS

| | | | | | |
|---|---|---|---|---|---|
| 5,416,666 | A | | 5/1995 | Maguire, Jr. | 361/681 |
| D362,426 | S | * | 9/1995 | Wilson et al. | D14/103 |
| 5,502,616 | A | | 3/1996 | Maguire, Jr. | 361/681 |
| D374,432 | S | | 10/1996 | Maquire, Jr. | D14/103 |
| 5,687,939 | A | * | 11/1997 | Moscovitch | 248/122.1 |
| D392,261 | S | | 3/1998 | Kodimer | D14/103 |
| D401,227 | S | | 11/1998 | Catta | D14/103 |
| D415,124 | S | | 10/1999 | Rooyakkers et al. | D14/103 |

* cited by examiner

OPERATOR WORKSTATION

RELATED APPLICATION INFORMATION

This application is a continuation of the U.S. patent application Ser. No. 09/239,688, filed on Jan. 29, 1999, now is U.S. Pat. No. 6,212,068 which is a continuation of U.S. Design Pat. No. 29/091,241 filed on Jul.24, 1998, now U.S. Pat. No. Design 415,124 and U.S. Provisional Patent Applicational Serial No. 60/102,712 filed on Oct. 1, 1998. The contents of the aforementioned applications are hereby incorporated by reference.

This patent application is related to co-pending design patent application entitled "Operator Console", Ser. No. 29/091,241, filed on Jul. 24, 1998, and co-pending provisional patent application "Operator Console", Ser. No. 60/102,712, filed on Oct. 1, 1998, both of which are incorporated herein by reference in their entireties.

TECHNICAL FIELD

The present invention is related to operator workstations. More specifically, the present invention is related to ergonomically advanced operator workstations including a versatile architecture and flat-panel displays.

BACKGROUND OF THE INVENTION

Operator workstations are used in many fields to provide human operators With access to computers used in monitoring and control applications. Systems utilizing such workstations include but are not limited to process, factory, machinery, security, building, environmental, space vehicle, and telecommunications control systems.

The architecture of computer consoles used in these fields may be as simple as a computer monitor and keyboard on a conventional desktop. However, in many situations this is insufficient and/or inefficient in that operator workstations must accommodate many functions in a space and cost effective manner while still being ergonomically compatible with the operators.

Prior operator workstation have been large bulky constructs with many disadvantages. They were primarily designed for older technology computer equipment which was large, bulky and had extensive cooling and wiring requirements. In many cases, equipment requiring regular service was within these consoles which the operators would have to abandon prior to service being performed. Operator worksurface was not maximized. Further, shipping, assembly and disassembly of these workstations was difficult given their architecture. In short, operator workstation technology has not kept pace with the computer technology contained within it.

The present invention is directed toward solutions to these above-identified problems.

SUMMARY OF THE INVENTION

Briefly described, in a first aspect the present invention comprises a workstation including a worksurface and left and right upper support members extending at least upward from the worksurface. At least one flat-panel display unit is mounted between the support members above the level of the worksurface. If there are multiple displays, they are mounted above one another, between the support members.

The workstation may also include lower support members which support the worksurface and the upper support members. A base may be connected to the lower support members and mounted therebetween.

As one example, the base may have a substantially triangular cross-section, while the lower support members may have a substantially triangular shape.

In further regard to the support members, they may have an arcuate shape curving upward from the worksurface. Further, the support members may comprise multiple linear segments, at obtuse angles to each other forming the arcuate shape. Some of the linear segments may respectively correspond to the flat-panel displays, which may be pivotally mounted at a central point within the linear segments of the support members corresponding to it. Also, a portion of the support members may extend below the worksurface.

An operator interface panel may be mounted between the support members, above the worksurface and below the displays. The operator interface panel may includes at least one human interface device which may be, for example, at least one annunciator panel, joystick, trackball, button and/or display. As an enhancement, the operator interface panel may include multiple displays which may be, for example, flat-panel touch-screen displays.

Further in regard to the operator interface panel, it may form an angle of between 90 and 180 degrees with the worksurface, and may have a substantially vertical frontal portion.

In another embodiment, the present invention includes an operator workstation having a base and a worksurface. Left and right support members are coupled to the base and support the worksurface. The support members have a substantially triangular shape with a vertex thereof disposed at the base. The workstation also includes an operator interface panel extending upward from the worksurface and forming an obtuse angle therewith.

As an enhancement, the support members may lean in a forward direction toward an operator position with respect to the workstation.

In accordance with further embodiments of the present invention, multiple operator workstations may be joined together. This joining may be performed using joining units.

Advantageously, the present invention provides an advancement to the art of operators workstations. The operator workstations embodied herein have an adaptable, expandable architecture and facilitate an enhanced man-machine interface and general operator environment.

BRIEF DESCRIPTION OF THE DRAWINGS

The subject matter regarded as the present invention is particularly pointed out and distinctly claimed in the concluding portion of the specification. The invention, however, both as to organization and method of practice, together with further objects and advantages thereof, may best be understood by reference to the following detailed description taken in conjunction with the accompanying. drawings in which:

FIGS. 2 and 4 depict embodiments of an operator workstations in accordance with the present invention, while

FIGS. 8 depicts a further embodiment of an operator workstation in accordance with the present invention, while

DETAILED DESCRIPTION OF THE PREFERRED EMBODIMENT

Figure 1:
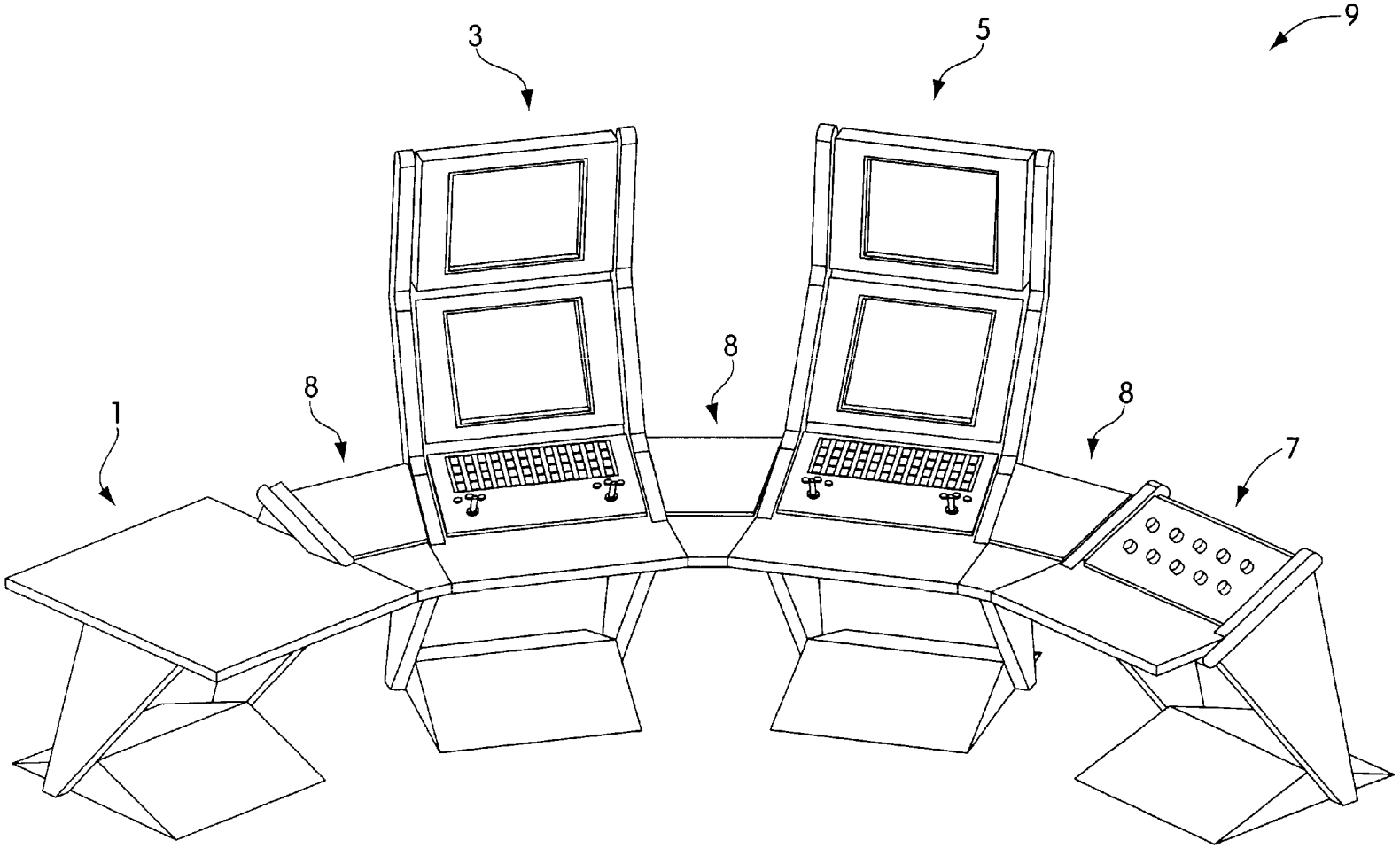
FIGS. 1 and 7 depict groups of operator workstations pursuant to embodiments of the present invention.

Turning to FIG. 1, an operator workplace 9 having multiple operator workstations arranged within it is depicted. Operator workstations 3 and 5 include multiple flat-panel displays, operator interface panels and worksurfaces. Operator workstation 1 provides a larger work surface, while operator workstation 7 includes an operator interface panel along with a worksurface. joining the arrangement of operator workstations are joining units 8 which mechanically couple the operator workstations to each other and provide a contiguous worksurface and operator interface panel appearance.

Figure 2:
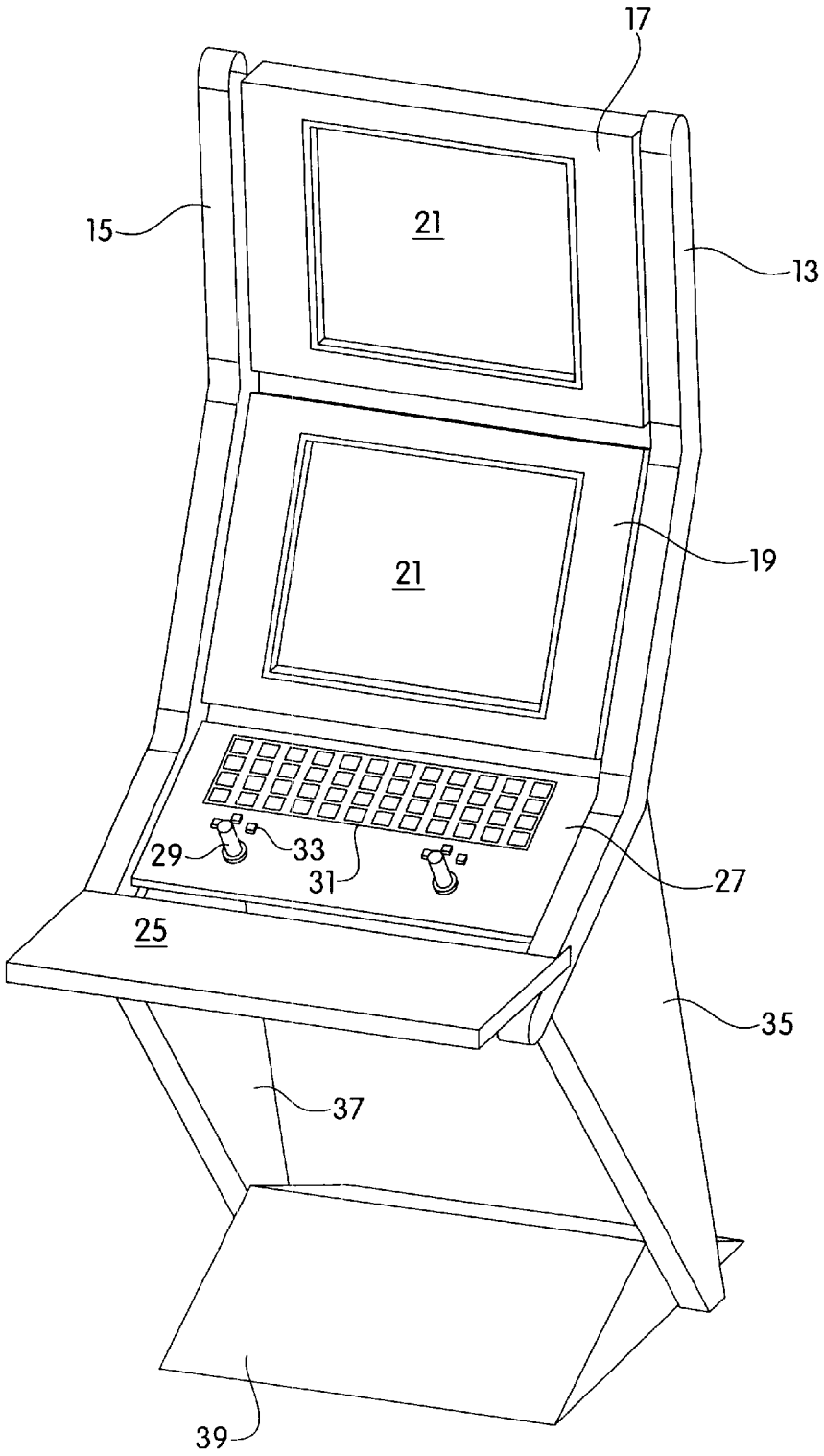
Figure 2A:
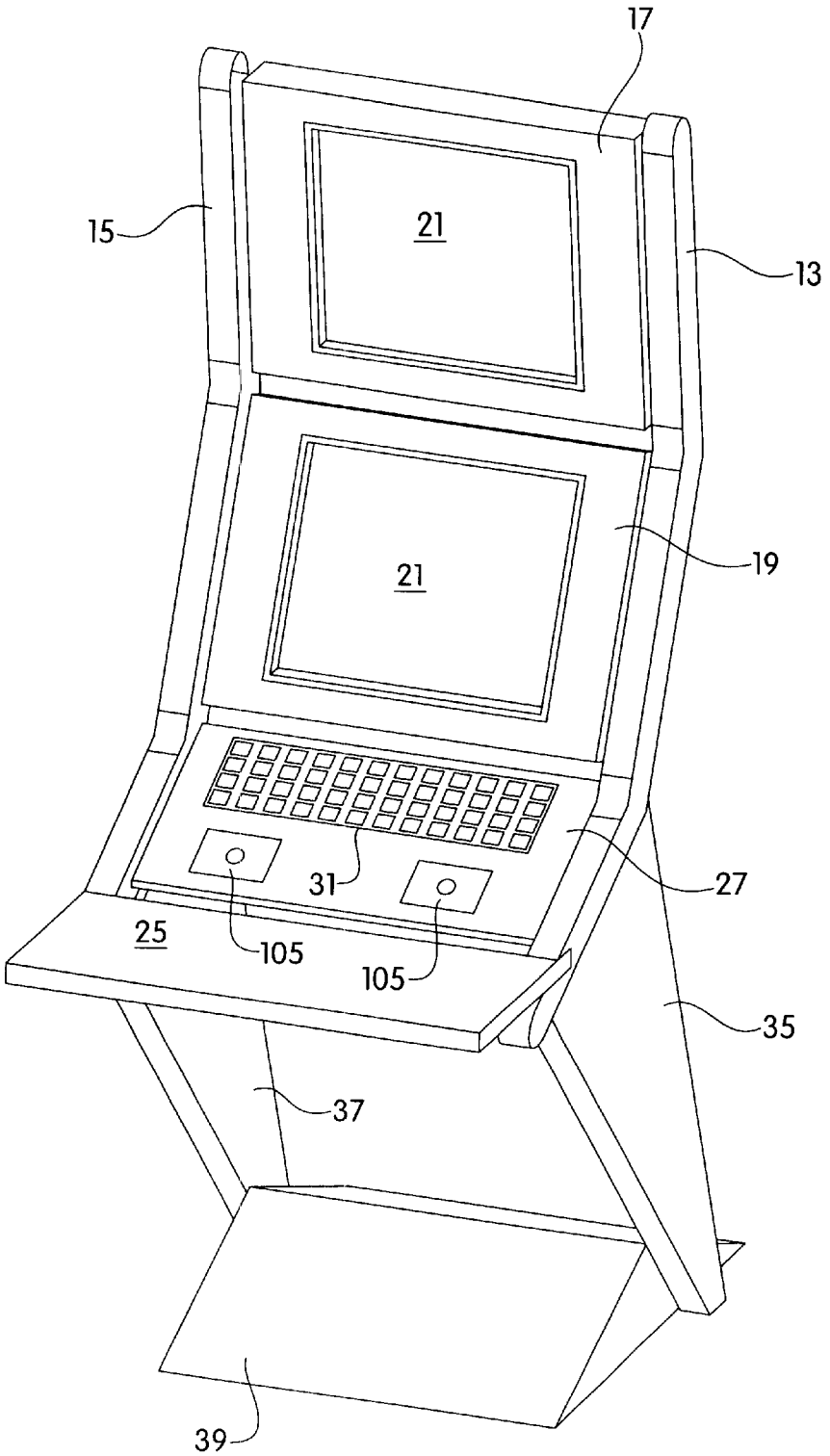
Figure 2B:
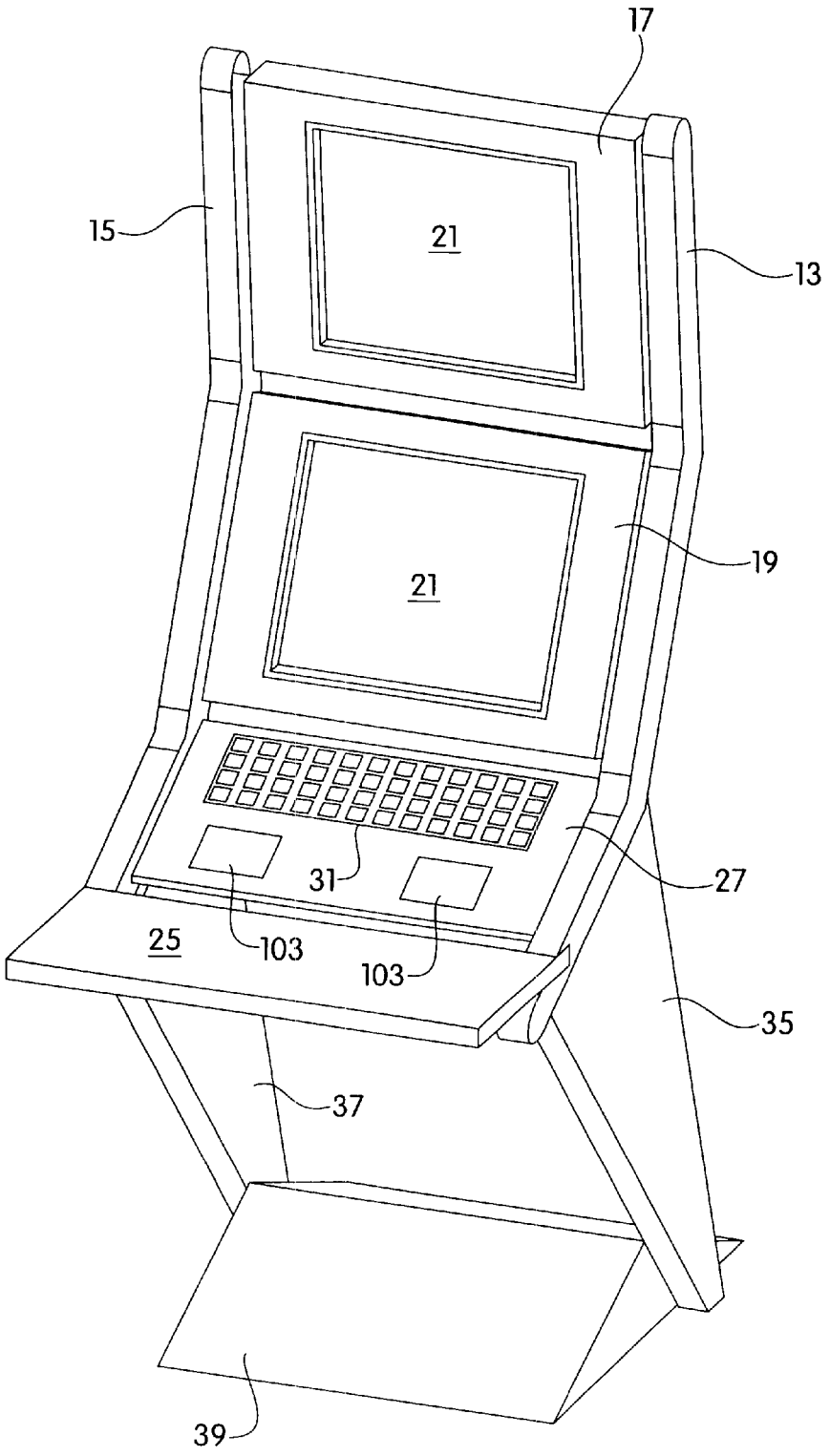

An example embodiment of operator workstations 3 and 5 of FIG. 1 is depicted in more detail in FIG. 2. A base 39 provides support for the operator workstation using a left lower support member 37 and a right lower support member 35. Mechanically coupled to the lower support members are left upper support member 15 and right upper support member 13. Worksurface 25 fits into a slot within the upper support members.

Between the support members is operator interface panel 27 that may include a variety of man-machine interface devices. For instance, depicted in this example embodiment is an annunciator panel 31 and joysticks 29 with buttons 33. In alternate embodiments, a small display may be within an operator interface panel and may particularly include touch sensitive displays and/or flat-panel displays. In one example, one or more touch sensitive flat-panel displays are usable by the operator for interacting with the control system (for example, to acknowledge alarms). The conventional keyboard and pointing device (i.e., trackball or mouse) is not shown, but could reside on, e.g., worksurface 25.

A pair of flat-panel displays is pivotally mounted between the upper support members in a vertical orientation. More particularly, upper flat-panel display unit 17 includes a flat panel display 21, and lower flat-panel display unit 19 also includes a flat-panel display 21. In other embodiments, more or less flat-panel display units may be included. For example, an operator workstation may include a single display, or three or more displays. The design of the upper support members would be modified to accommodate the particular number of displays.

Figure 3:
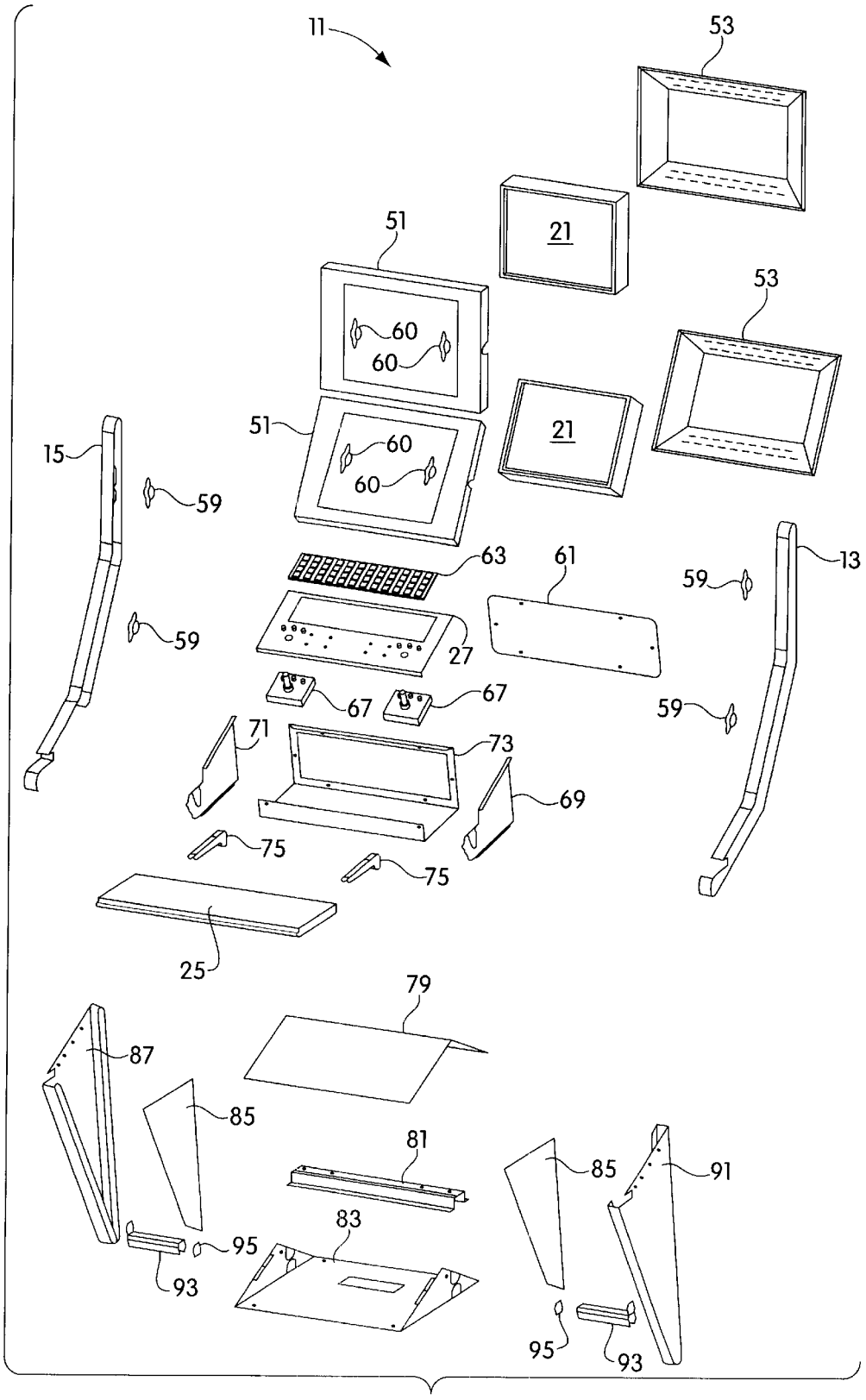
FIG. 3 and 5 depict respective assembly views thereof.

Depicted in FIG. 3 is an assembly view of the operator workstation of FIG. 1. Beginning at base 39, the several pieces that form the base are depicted. A base frame 83 includes a base support member 81 mounted therein for structural strength. A base cover 79 is connected to and covers base frame 83. As assembled, base 39 has a substantially triangular cross section.

The lower support members 35 and 37 are formed from left and right lower support member frames 87 and 91, respectively. Lower support member side panels 85 are also provided and cover the interior opening of the lower support members. Lower support member brackets 93 extend through an opening in base frame 83 and couple thereto thereby providing mechanical support for the lower support members. A cap 95 covers an end of the lower support members 93. As assembled, the lower support members have a substantially triangular shape and includes the vertex point at the base being flattened, and are oriented to lean toward the operator position.

Coupled to the upper portion of the lower support members is an operator interface panel assembly. This assembly includes left and right panel covers 71 and 69 coupled to an operator interface frame 73. Rear panel 61 encloses the assembly from the rear thereof, and operator interface panel 27 covers the front thereof. In this particular example, operator interface panel 27 includes annunciator panel 63 and joysticks 67.

The lower support members connect to the operator interface panel assembly which provides a mechanical coupling between the lower portions of the operator workstation (including lower support members) and the upper portions of the operator workstation (including the upper support members).

More specifically, the upper support members 15 and 13 along with worksurface 25 (vis-ávis brackets 75) are mechanically coupled to the operator interface panel assembly. Worksurface 25 is fitted into mating slots within the upper support members 13 and 15.

Each of the flat panel display units (e.g., upper flat-panel display unit 17 and lower flat-panel display unit 19) include a display housing 51, a rear display cover 53 and a flat-panel display 21. Display housing 51 also serves as a bezel, or mask, for flat-panel display 21. This way, flat-panel display 21 may be selected from a variety of technologies for flat panel displays including, for example, completely packaged flat-panel display units of which the manufacturer's specific enclosure and electronics are hidden by the masking of display housing 51. For instance, in one example, flat-panel display 21 is a NEC brand, 20.1" flat-panel display.

Display housing 51 also serves as a mount for interior pivot mounts 60 which mate with corresponding exterior pivot mounts 59 located on their respective upper support members. Preferably, these pivot mounts are implemented using a bushing assembly.

In the embodiment shown, upper support members 13 and 15 have a substantially arcuate shape extending upward and rearward from, for example, worksurface 25. This arcuate shape is formed in each upper support member by several linear segments at obtuse angles between them. Each of these linear segments corresponds to its respective operator interface panel and flat-panel display units. The pivot point for the pivot mounts is located at a central point within the linear segment corresponding to the respective display.

Figure 4:
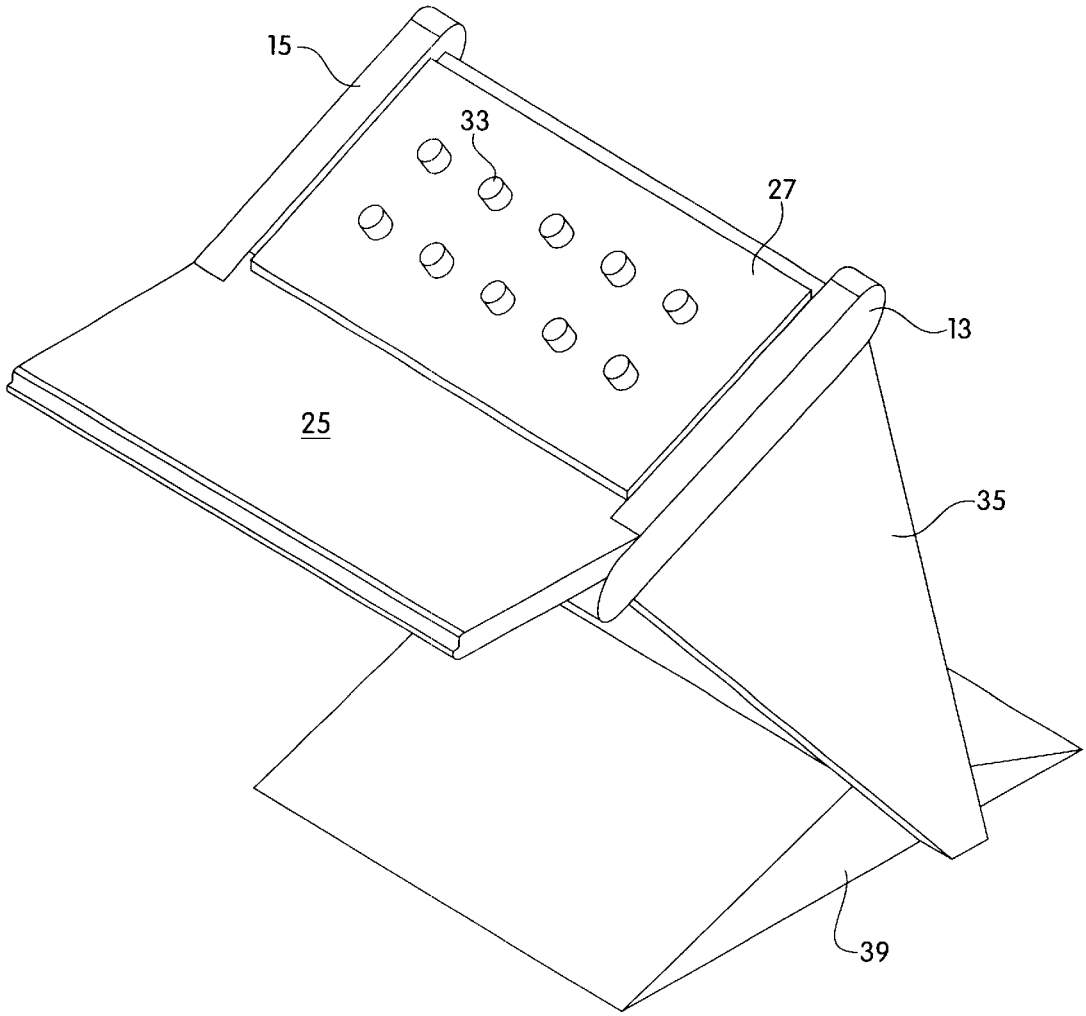

Turning to FIG. 4, operator workstation 1 of FIG. 1 is depicted. This operator workstation shares many of the elements of the lower portion of the operator workstation embodiment of FIGS. 2–3. A base 39 provides support for a pair of lower support members, namely right lower support member 35 and left lower support member 37 (not shown). A worksurface 25 and operator interface panel 27 including buttons 33 are provided. Furthermore, right and left upper support members 13 and 15, respectively, are included and are sized to accommodate this particular workstation embodiment.

Figure 5:
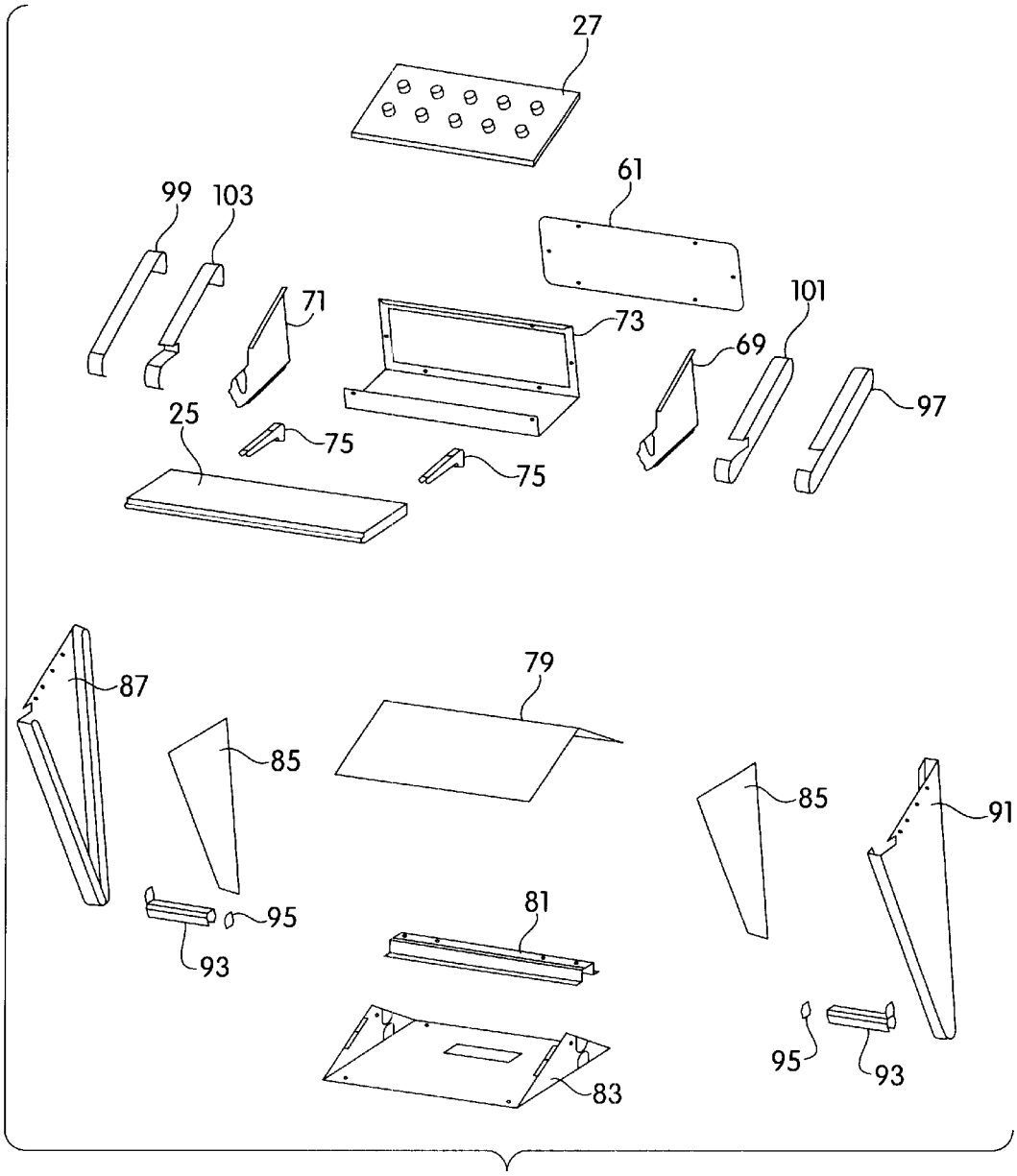

Depicted in FIG. 5 is an assembly view of the operator workstation of FIG. 4. Beginning with base 39, the several pieces that form the base are depicted. A base frame 83 includes a base support member 81 mounted therein for structural strength. A base cover 79 is connected to and covers base frame 83. As assembled, base 39 has a substantially triangular cross section.

The lower support members 35 and 37 are formed from left and right lower support member frames 87 and 91, respectively. Lower support member side panels 85 are also provided and cover the interior opening of the lower support members. Lower support member brackets 93 extend through an opening in base frame 83 and couple thereto thereby providing mechanical support for the lower support members. A cap 95 covers an end of the lower support members 93. As assembled, the lower support members have a substantially triangular shape (absent, for example, the vertex point at the base which is flattened), and are oriented to lean toward the operator position.

Operator interface panel 27 is part of an operator interface assembly including left and right panel covers 71 and 69 coupled to an operator interface frame 73. Panel 61 encloses the assembly from the rear thereof. The variety of options regarding man-machine interface described in connection with other embodiments herein (e.g., FIG. 3) are similarly applicable.

Upper support members 101 and 93 along with worksurface 25 (vis-ávis brackets 75) are mechanically coupled to the operator interface panel assembly. Right and left upper support member covers 97 and 99 are provided. Worksurface 25 is fitted into mating slots within the upper support members 101 and 103 and upper. support member covers 97 and 99.

Figure 6:
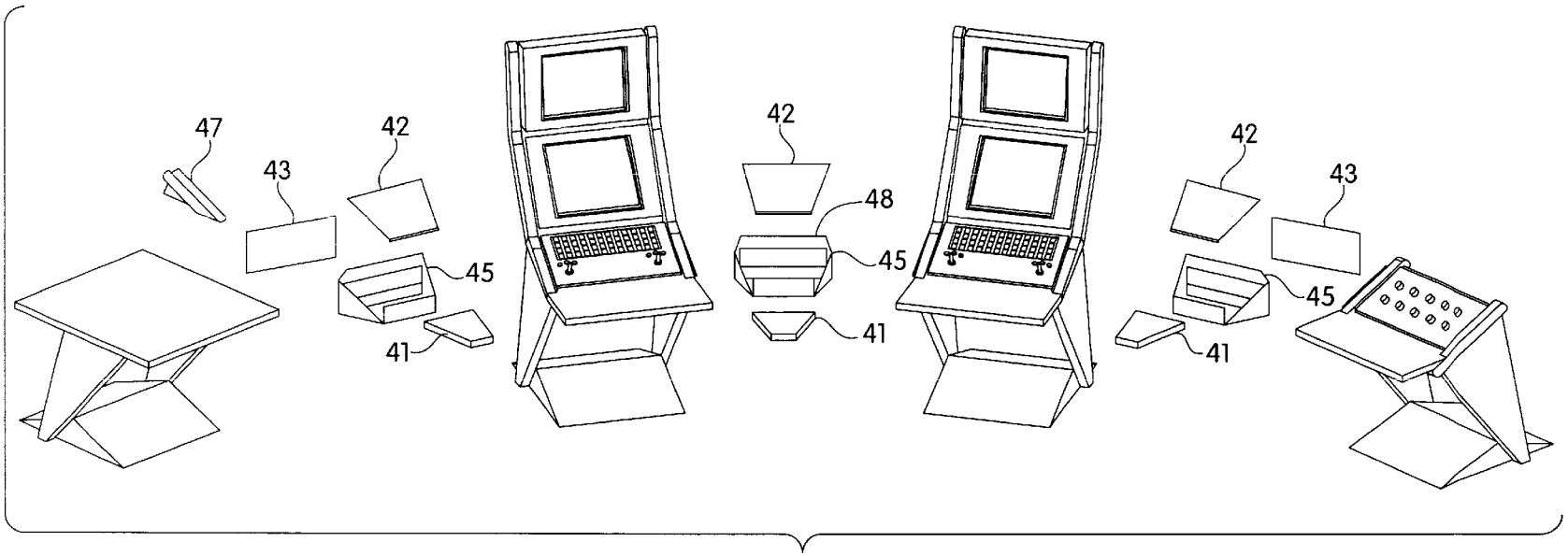
FIGS. 6 and 11 depict partial assembly views of the groups of operator workstations of FIGS. 1 and 7, respectively, in conformance with embodiments of the present invention.

Turning to FIG. 6, a partial assembly view of the workspace of FIG. 1 depicts assembly views of joining units 8 used to couple the operator workstations to each other. Each joining unit includes a joining frame 45 which has a joining panel 41 attached thereto. Joining panel 41 is aligned with the operator interface panels of adjoining operator workstations to provide a contiguous operator interface panel appearance. A back cover 43 encloses joining frame 45. A decorative piece 49 provides aesthetic continuity, has the appearance of an upper support member, and is used in configurations where an adjoining operator workstation does not have an upper support member. An angled worksurface 47 is included in the joining unit and is attached thereto. A contiguous worksurface among the operator workstations is provided by angled worksurface 47.

Figure 7:
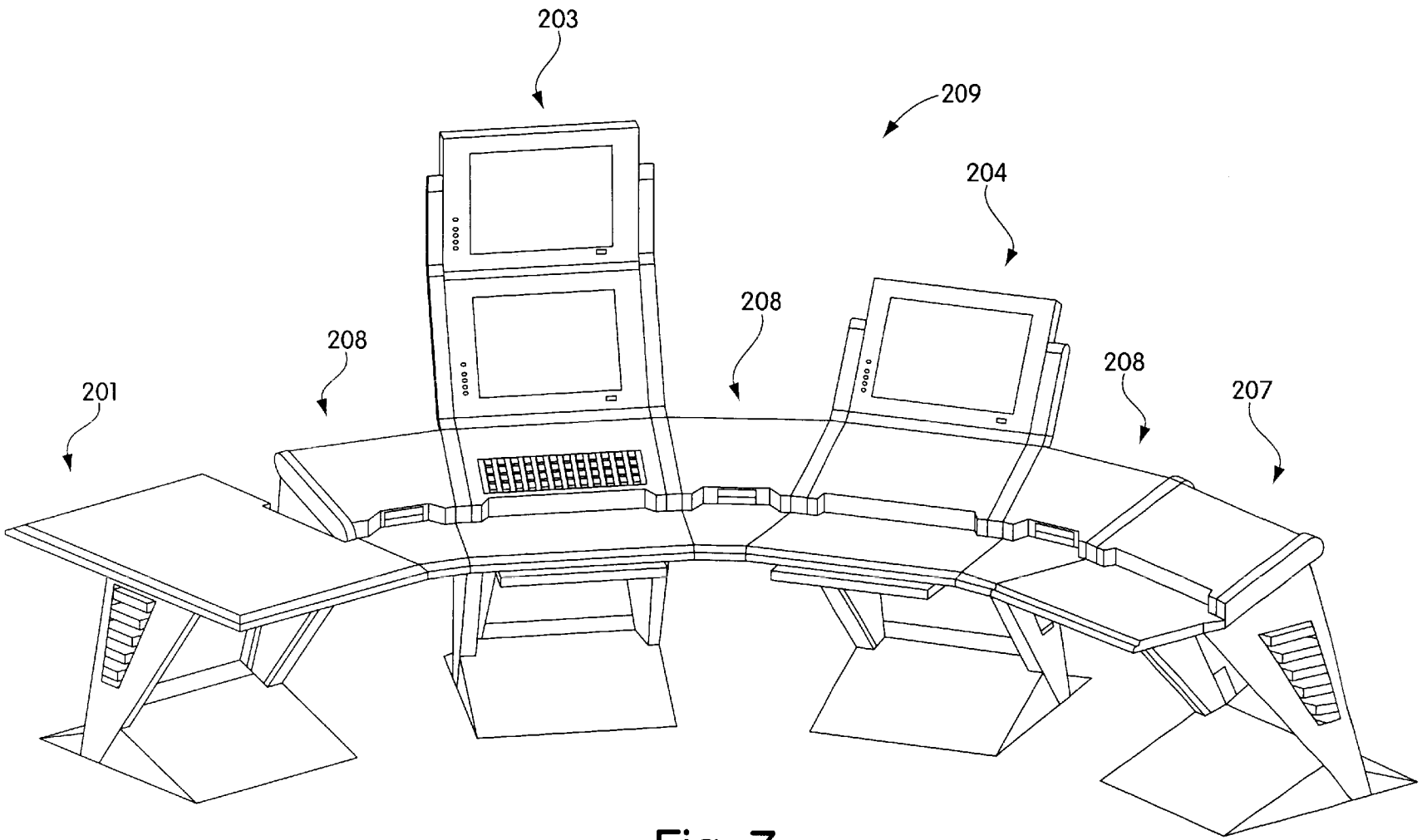

Turning to FIGS. 7–11, other embodiments of operator workstations according to the present invention are shown. FIG. 7 depicts an operator workplace 209 including operator workstations 203 (having dual displays) and 204 (having a single display). Operator workstation 201 provides a large work surface, while operator workstation 207 includes an operator interface panel along with a worksurface. Joining units 208 mechanically couple the operator workstations to each other and provide a contiguous worksurface and operator interface panel appearance.

Figure 8:
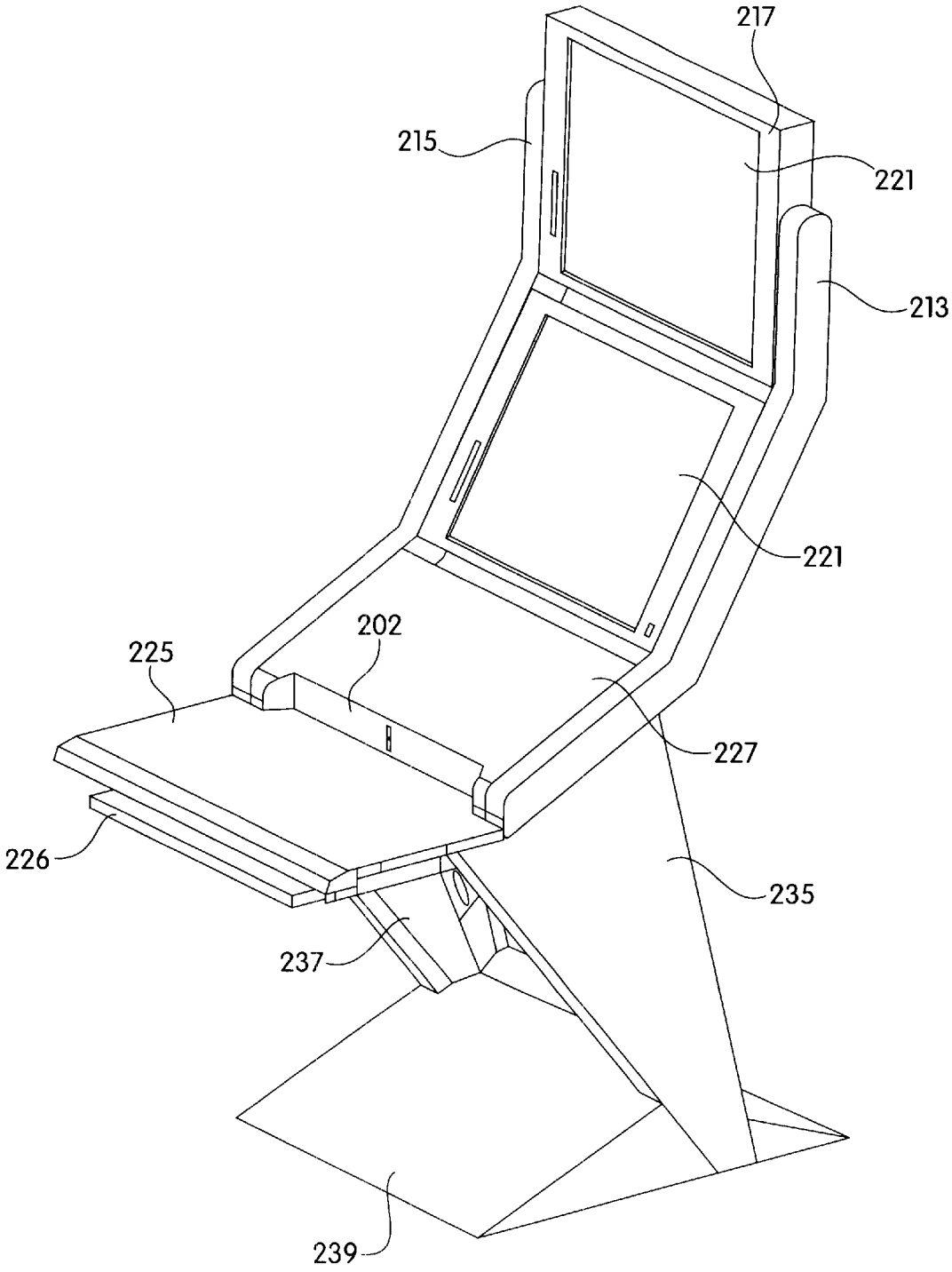

An example embodiment of operator workstations 203 is depicted in more detail in FIG. 8. A base 239 provides support for the operator workstation using a left lower support member 237 and a right lower support member 235. Mechanically coupled to the lower support members are left upper support member 215 and right upper support member 213. Worksurface 225 abuts the upper support members. A slide out keyboard tray 226 is mounted under worksurface 225.

Operator interface panel 227 may include a similar wide variety of man-machine interface devices as previously discussed herein (e.g., in regard to operator interface panel 27 of FIG. 2). This embodiment supports one or more flat-panel displays as described in regard to the previous embodiment, and in the current example includes two flat-panel displays 221. As shown in, e.g., FIG. 8, each of the operator workstations in, e.g., FIG. 7 has a flat, vertically oriented front surface 202 on the operator interface panels to accommodate, e.g., removable media drives (e.g., CD-ROM or floppy disc) or other amenities such as swing-out coffee cup holders.

Figure 9:
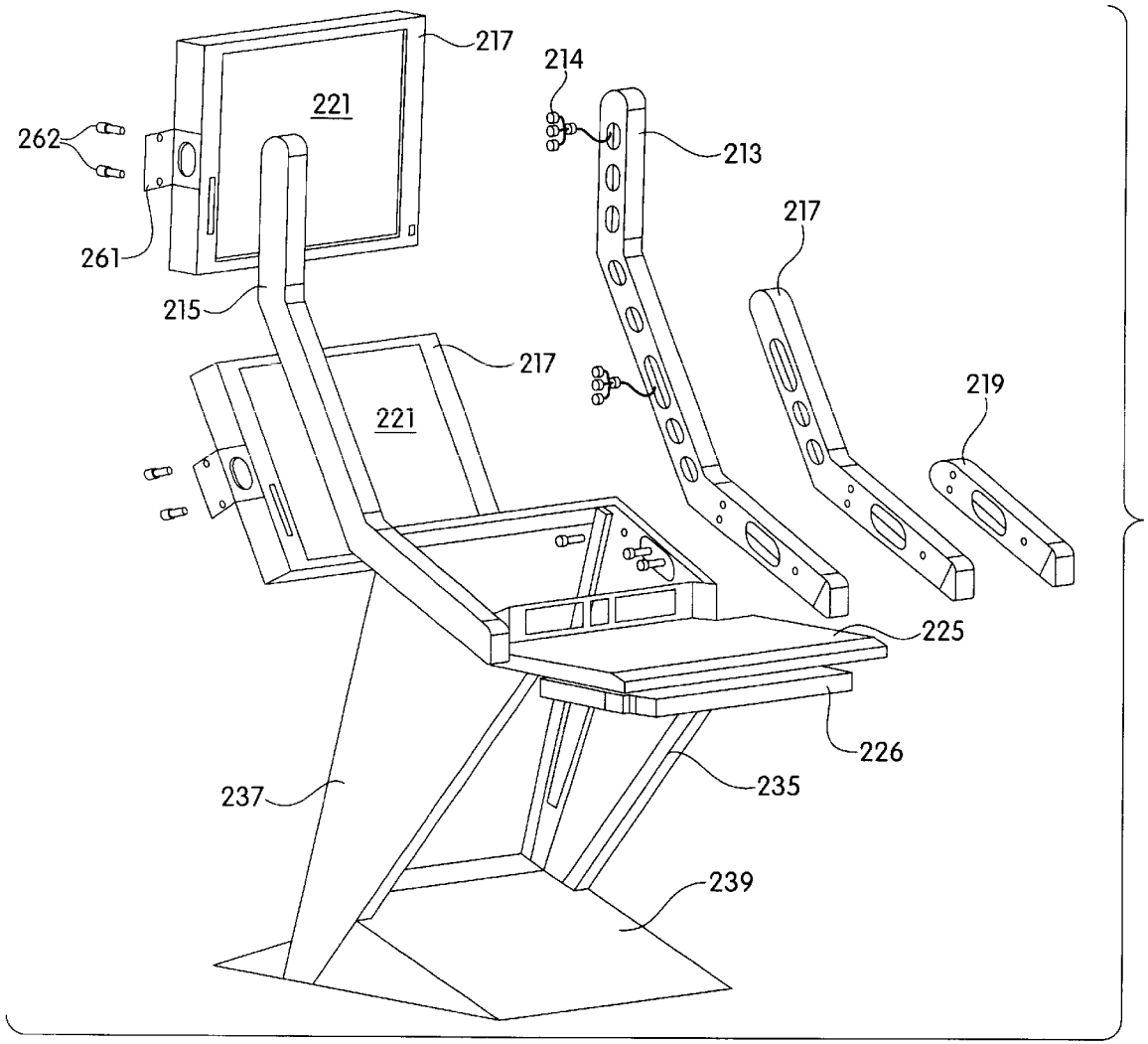
FIG. 9 depicts an assembly view thereof.

An assembly view of the operator workstation of FIG. 8 is depicted in FIG. 9. Base 239 and lower support members 237 and 235 may be constructed as described hereinbefore (e.g., in regard to base 39 and members 35 and 37) or using other single or multi-part fabrications. Shown herein are right upper support member 213, 217 and 219 which are alternatively used for operator workstations with two, one, and none flat-panel displays, respectively (corresponding left upper support members would be used). Wiring 214 is passed through voids in the uppers support members. Pivoting mounts 261 (and fasteners 262) are used to couple the flat-panel displays 221 within display housings 217 to the upper support members.

Figure 10:
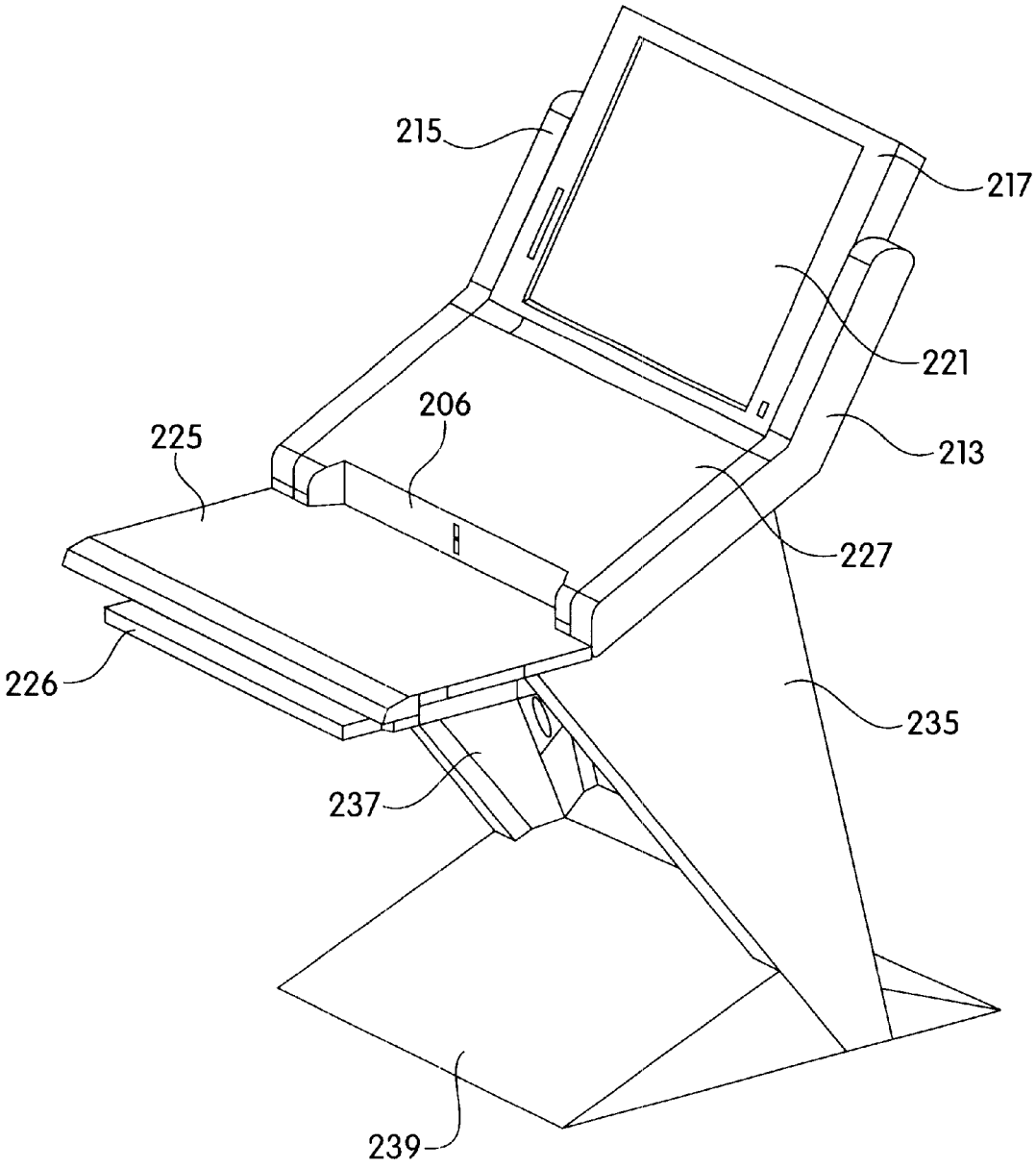
FIG. 10 depicts another assembly view of an operator workstation pursuant to the present invention.

FIG. 10 depicts a partially assembled operator workstation and illustrates the mounting of workspace 225 to the lower support members, and the joining of keyboard tray 226 to workspace 225.

Figure 11:
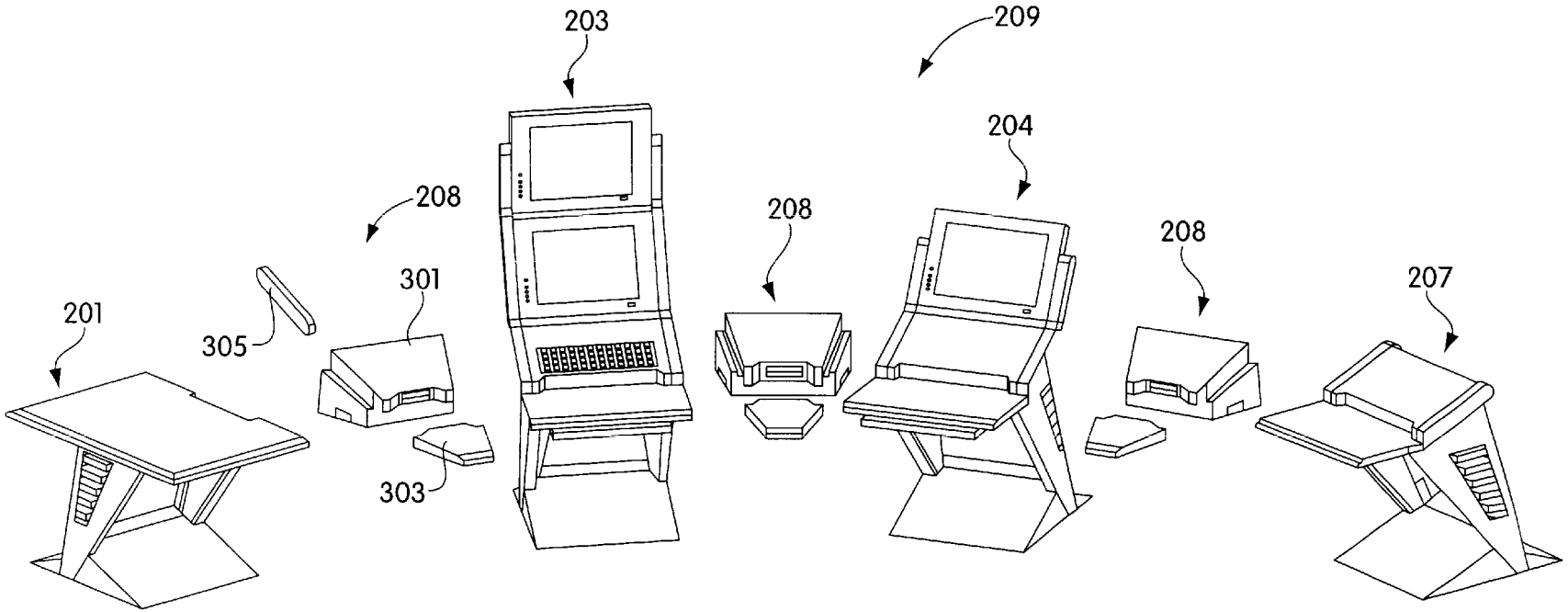

FIG. 11 depicts a partial assembly view of the workspace of FIG. 7 and shows joining units 208 used to couple the operator workstations to each other. These joining units 208 are fabricated similarly to joining units 8 discussed hereinabove.

Advantageously, the present invention provides an advancement to the art of operators workstations. The operator workstations embodied herein have an adaptable, expandable architecture and facilitate an enhanced man-machine interface and general operator environment.

While the invention has been described in detail herein, in accordance with certain preferred embodiments thereof, many modifications and changes thereto may be affected by those skilled in the art. Accordingly, it is intended by the appended claims to cover all such modifications and changes as fall within the true spirit and scope of the invention.

We claim:

1. A workstation comprising:

a worksurface, left and right upper support members extending upward from the worksurface, left and right lower support members supporting the left and right upper support members, and a plurality of flat-panel display units positioned above the worksurface and mounted between the upper support members, wherein the display units are vertically aligned, and further wherein at least one of the display units is pivotally mounted between the support members.

2. A workstation as claimed in claim 1, wherein the left and right upper support members intersect the worksurface and extend downward from the worksurface.

3. A workstation as claimed in claim 1, further comprising a base coupled to the left and right lower support members.

4. A workstation as claimed in claim 1, further comprising an operator interface panel positioned above the worksurface and below the plurality of display units and mounted between the left and right support members.

5. A workstation as claimed in claim 4, wherein the operator interface panel forms an obtuse angle with the worksurface.

6. A workstation as claimed in claim 5, wherein the operator interface panel has a substantially vertical front portion.

7. A workstation as claimed in claim 6, wherein the substantially vertical front portion is adapted to accommodate a media drive.

8. A workstation comprising:

a worksurface, left and right upper support members extending upward from the worksurface, left and right lower support members supporting the left and right upper support members, and a flat-panel display unit positioned above the worksurface and pivotally mounted between the support members.

9. A workstation as claimed in claim 8, wherein the left and right upper support members intersect the worksurface and extend downward from the worksurface.

10. A workstation as claimed in claim 8, further comprising a base coupled to the left and right lower support members.

11. A workstation as claimed in claim 8, further comprising an operator interface panel positioned above the worksurface and below the display unit and mounted between the left and right support members.

12. A workstation as claimed in claim 11, wherein the operator interface panel forms an obtuse angle with the worksurface.

13. A workstation as claimed in claim 12, wherein the operator interface panel has a substantially vertical front portion.

14. A workstation as claimed in claim 13, wherein the substantially vertical front portion is adapted to accommodate a media drive.

15. A workstation comprising:

a base, a worksurface, left and right upper support members extending upward and downward from the worksurface and intersecting the worksurface, left and right lower support members supporting the left and right upper support members and coupled to the base, and a plurality of flat-panel display units positioned above the worksurface and mounted between the left and right upper support members, wherein the display units are vertically aligned, and further wherein at least one of the display units is pivotally mounted between the left and right upper support members.

16. A workstation according to claim 15, further comprising an operator interface panel positioned above the worksurface and below the plurality of display units and mounted between the left and right upper support members.

17. A workstation as claimed in claim 16, wherein the operator interface panel forms an obtuse angle with the worksurface.

18. A workstation as claimed in claim 17, wherein the operator interface panel has a substantially vertical front portion.

19. A workstation as claimed in claim 18, wherein the substantially vertical front portion is adapted to accommodate a media drive.

20. A workstation comprising:

a base, a worksurface, left and right upper support members extending upward and downward from the worksurface and intersecting the worksurface, left and right lower support members supporting the left and right upper support members and coupled to the base, and a flat-panel display unit positioned above the worksurface and pivotally mounted between the left and right upper support members.

21. A workstation according to claim 20, further comprising an operator interface panel positioned above the worksurface and below the display unit and mounted between the left and right upper support members.

22. A workstation as claimed in claim 21, wherein the operator interface panel forms an obtuse angle with the worksurface.

23. A workstation as claimed in claim 22, wherein the operator interface panel has a substantially vertical front portion.

24. A workstation as claimed in claim 23, wherein the substantially vertical front portion is adapted to accommodate a media drive.

25. A workstation comprising:

a worksurface, left and right support members extending upward and downward from the worksurface and intersecting the worksurface, an operator interface panel positioned above the worksurface and forming an obtuse angle with the worksurface, and a plurality of flat-panel display units positioned above the operator interface panel, wherein the display units are vertically aligned, and further wherein at least one of the display units is pivotally mounted between the left and right support members.

26. A workstation as claimed in claim 25, wherein the operator interface panel has a substantially vertical front portion.

27. A workstation as claimed in claim 26, wherein the substantially vertical front portion is adapted to accommodate a media drive.

28. A workstation as claimed in claim 25, further comprising a flat-panel display unit positioned above the operator interface panel and pivotally mounted between the left and right support members.

29. A workstation as claimed in claim 25, wherein the left and right support members comprise left and right upper support members, and wherein the workstation further comprises left and right lower support members supporting the left and right upper support members.

30. A workstation as claimed in claim 29, further comprising a base coupled to the left and right lower support members.

31. A workstation comprising:

a worksurface, left and right support members extending upward from the worksurface, a plurality of flat-panel display units positioned above the worksurface and mounted between the support members, wherein the display units are vertically aligned, and further wherein at least one of the display units is pivotally mounted between the support members, and an operator interface panel positioned above the worksurface and below the plurality of display units and mounted between the left and right support members.

32. A workstation as claimed in claim 31, wherein the operator interface panel forms an obtuse angle with the worksurface.

33. A workstation as claimed in claim 32, wherein the operator interface panel has a substantially vertical front portion.

34. A workstation as claimed in claim 33, wherein the substantially vertical front portion is adapted to accommodate a media drive.

35. A workstation comprising a base, a worksurface, left and right support members coupled to the base and supporting the worksurface, a flat-panel display unit pivotally mounted above the plane of the worksurface, and an operator interface panel positioned above the plane of the worksurface and below the flat-panel display unit.

36. A workstation as claimed in claim 35, wherein the base has a substantially triangular cross-section.

37. A workstation as claimed in claim 35, wherein the left and right support members extend above and below the plane of the worksurface.

38. A workstation as claimed in claimed 37, wherein the left and right support members intersect the worksurface.

39. A workstation as claimed in claim 35, wherein the left and right support members lean in a forward direction toward an operator position with respect to the workstation.

40. A workstation as claimed in claim 35, wherein the left and right support members have a substantially triangular shape with a vertex thereof disposed at the base.

41. A workstation as claimed in claim 35, wherein the flat-panel display unit is pivotally mounted between the left and right upper support members.

42. A workstation as claimed in claim 35, wherein the operator interface panel forms an obtuse angle with the worksurface.

43. A workstation as claimed in claim 42, wherein the operator interface panel has a substantially vertical front portion.

44. A workstation as claimed in claim 43, wherein the substantially vertical front portion accommodates a media drive.

45. A workstation as claimed in claim 35, wherein the operator interface panel includes at least one human interface device.

46. A workstation as claimed in claim 45, wherein the human interface device comprises at least one of an annunciator panel, a joystick, a trackball, a button, and a display.

47. A workstation as claimed in claim 46, wherein the operator interface panel includes a plurality of displays.

48. A workstation as claimed in claim 46, wherein the display comprises a flat-panel display.

49. A workstation as claimed in claim 46, wherein the display comprises a touch-screen display.

50. A workstation as claimed in claim 46, wherein the display comprises a touch-screen flat-panel display.

51. A workstation comprising a base, a worksurface, left and right support members coupled to the base and supporting the worksurface, a plurality of flat-panel display units positioned above the plane of the worksurface, wherein at least one of the display units is pivotally mounted, and an operator interface panel positioned above the plane of the worksurface and below the plurality of flat-panel display units.

52. A workstation as claimed in claim 51, wherein the base has a substantially triangular cross-section.

53. A workstation as claimed in claim 51, wherein the left and right support members extend above and below the plane of the worksurface.

54. A workstation as claimed in claim 51, wherein the left and right support members intersect the worksurface.

55. A workstation as claimed in claim 51, wherein the left and right support members lean in a forward direction toward an operator position with respect to the workstation.

56. A workstation as claimed in claim 51, wherein the left and right support members have a substantially triangular shape with a vertex thereof disposed at the base.

57. A workstation as claimed in claim 51, wherein the at least one of the display units is pivotally mounted between the left and right upper support members.

58. A workstation as claimed in claim 51, wherein the plurality of display units are vertically aligned.

59. A workstation as claimed in claim 51, wherein the operator interface panel forms an obtuse angle with the worksurface.

60. A workstation as claimed in claim 59, wherein the operator interface panel has a substantially vertical front portion.

61. A workstation as claimed in claim 60, wherein the substantially vertical front portion accommodates a media drive.

62. A workstation as claimed in claim 51, wherein the operator interface panel includes at least one human interface device.

63. A workstation as claimed in claim 62, wherein the human interface device comprises at least one of an annunciator panel, a joystick, a trackball, a button, and a display.

64. A workstation as claimed in claim 63, wherein the operator interface panel includes a plurality of displays.

65. A workstation as claimed in claim 63, wherein the display comprises a flat-panel display.

66. A workstation as claimed in claim 63, wherein the display comprises a touch-screen display.

67. A workstation as claimed in claim 63, wherein the display comprises a touch-screen flat-panel display.

* * * * *